US010049623B2

(12) United States Patent
Sun et al.

(10) Patent No.: US 10,049,623 B2
(45) Date of Patent: Aug. 14, 2018

(54) ELECTRONIC DEVICE AND DISPLAY METHOD

(71) Applicant: Lenovo (Beijing) Limited, Beijing (CN)

(72) Inventors: Tao Sun, Beijing (CN); Shaofeng Zhu, Beijing (CN)

(73) Assignee: Lenovo (Beijing) Limited, Beijing (CN)

( * ) Notice: Subject to any disclaimer, the term of this patent is extended or adjusted under 35 U.S.C. 154(b) by 168 days.

(21) Appl. No.: 15/085,334

(22) Filed: Mar. 30, 2016

(65) Prior Publication Data

US 2017/0193924 A1 Jul. 6, 2017

(30) Foreign Application Priority Data

Dec. 30, 2015 (CN) ..... 2015 1 1021285
Dec. 30, 2015 (CN) ..... 2015 1 1021559

(51) Int. Cl.
*G09G 3/34* (2006.01)

(52) U.S. Cl.
CPC ..... *G09G 3/3406* (2013.01); *G09G 2320/02* (2013.01); *G09G 2330/021* (2013.01); *G09G 2360/145* (2013.01); *G09G 2380/14* (2013.01)

(58) Field of Classification Search
None
See application file for complete search history.

(56) References Cited

U.S. PATENT DOCUMENTS 7,808,475 B2 * 10/2010 Brown ..... G09G 3/3406 345/102
8,824,040 B1 * 9/2014 Buchheit ..... G09G 3/30 345/107
9,410,845 B1 * 8/2016 Toepel ..... G01J 1/44
2003/0132908 A1 7/2003 Herb et al.
2003/0214697 A1 * 11/2003 Duthaler ..... G02F 1/167 359/296
2006/0182932 A1 * 8/2006 Song ..... G09F 9/372 428/144
2007/0284994 A1 * 12/2007 Morimoto ..... C09K 11/0883 313/483
2008/0245949 A1 * 10/2008 Morimoto ..... G01J 1/32 250/205
2009/0167676 A1 * 7/2009 Edwards ..... G09G 3/3406 345/102

(Continued)

FOREIGN PATENT DOCUMENTS

CN 1568442 A 1/2005
CN 1904977 A 1/2007

(Continued)

*Primary Examiner* — Joseph Haley
*Assistant Examiner* — Karin Kiyabu
(74) *Attorney, Agent, or Firm* — Ference & Associates LLC

(57) ABSTRACT

An embodiment provides a method, including: displaying, on a display device, visual information represented via electronic ink, wherein the electronic ink comprises a plurality of particles; modifying, using a processor, the display device to increase visibility of the electronic ink; wherein said modifying is performed using at least one of the plurality of particles. Other embodiments are described and claimed.

10 Claims, 17 Drawing Sheets

(56) References Cited

U.S. PATENT DOCUMENTS

| | | | | |
|---|---|---|---|---|
| 2010/0149145 | A1* | 6/2010 | Van Woudenberg | G09G 3/34 345/207 |
| 2012/0307344 | A1* | 12/2012 | Han | G02F 1/167 359/296 |
| 2013/0278147 | A1* | 10/2013 | Vetsuypens | G02F 1/133602 315/151 |
| 2014/0204128 | A1* | 7/2014 | Jiang | G02F 1/133617 345/690 |

FOREIGN PATENT DOCUMENTS

| | | | |
|---|---|---|---|
| CN | 201069507 | Y | 6/2008 |
| CN | 101311807 | A | 11/2008 |
| CN | 101699342 | A | 4/2010 |
| CN | 101751725 | A | 6/2010 |
| CN | 102081906 | A | 6/2011 |
| CN | 102650788 | A | 8/2012 |
| CN | 105182653 | A | 12/2015 |
| JP | 2007065406 | A | 3/2007 |
| JP | 2008058358 | A | 3/2008 |

* cited by examiner

| | | |
|---|---|---|
| 1 | 3 | 2 |
| 2 | 1 | 3 |
| 3 | 2 | 1 |
| 1 | 3 | 2 |
| 2 | 1 | 3 |
| 3 | 2 | 1 |
| 1 | 3 | 2 |
| 2 | 1 | 3 |
| 3 | 2 | 1 |

FIG. 18

| | | |
|---|---|---|
| 1 | 1 | 1 |
| 2 | 2 | 2 |
| 3 | 3 | 3 |
| 1 | 1 | 1 |
| 2 | 2 | 2 |
| 3 | 3 | 3 |
| 1 | 1 | 1 |
| 2 | 2 | 2 |
| 3 | 3 | 3 |

FIG. 19

| | | | | | | | | | |
|---|---|---|---|---|---|---|---|---|---|
| 1 | 2 | 1 | 2 | 1 | 2 | 1 | 2 | 1 | 2 |
| 3 | 0 | 3 | 0 | 3 | 0 | 3 | 0 | 3 | 0 |
| 1 | 2 | 1 | 2 | 1 | 2 | 1 | 2 | 1 | 2 |
| 3 | 0 | 3 | 0 | 3 | 0 | 3 | 0 | 3 | 0 |

FIG. 20

ELECTRONIC DEVICE AND DISPLAY METHOD

CLAIM FOR PRIORITY

This application claims priority to Chinese Application Nos. 201511021285.8 and 201511021559.3, each filed on Dec. 30, 2015, the contents of which are fully incorporated by reference herein.

TECHNICAL FIELD

The present disclosure relates to the field of electronic devices, and in particular, relates to an electronic device and display method thereof.

BACKGROUND

With the development of electronic technology, the E-ink Display technology is widely used in various electronic devices.

In the prior art, the E-ink Display technology relied on the reflection principle for the surrounding ambient light, it displays by using the reflected light and in the case of a very low ambient light, like a human reading ordinary paper, users cannot identify the content on the E-ink Display for its low brightness. Additionally, E-ink Display can only support simple colors and gray scales, for example, it can only display in black and white and cannot achieve a rich color display, thereby leading to a poor user experience.

BRIEF SUMMARY

In summary, one aspect provides an electronic device, comprising: a body; an E-ink display disposed on the body, the E-ink display housing E-ink material, the E-ink material comprising at least one ink particle and at least one energy storage particle; a processor, operatively connected to the E-ink Display, for controlling the E-ink display to display content; wherein, the at least one energy storage particle is used for: receiving and storing ambient light energy when ambient light intensity exceeds a first threshold; and releasing stored ambient light energy when ambient light intensity is below a second threshold, the first threshold being less than or equal to the second threshold.

Another aspect provides an E-ink Display, comprising: at least two compartment groups; wherein each of the compartment groups comprise at least three compartments, the compartments are provided with ink particles, the color of the ink particles in any two compartments of the same compartment group are different, and based on the ink particles the pixel color of the compartment group can be adjusted.

A further aspect provides a method, comprising: displaying, on a display device, visual information represented via electronic ink, wherein the electronic ink comprises a plurality of particles; modifying, using a processor, the display device to increase visibility of the electronic ink; wherein said modifying is performed using at least one of the plurality of particles.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

BRIEF DESCRIPTION OF THE SEVERAL VIEWS OF THE DRAWINGS

FIG. 18 is a specific schematic structure diagram of an E-ink Display embodiment 10.

FIG. 19 is another specific schematic structure diagram of an E-ink Display embodiment 10.

FIG. 20 is another specific schematic structure diagram of an E-ink Display embodiment 10.

DETAILED DESCRIPTION

Figure 1:
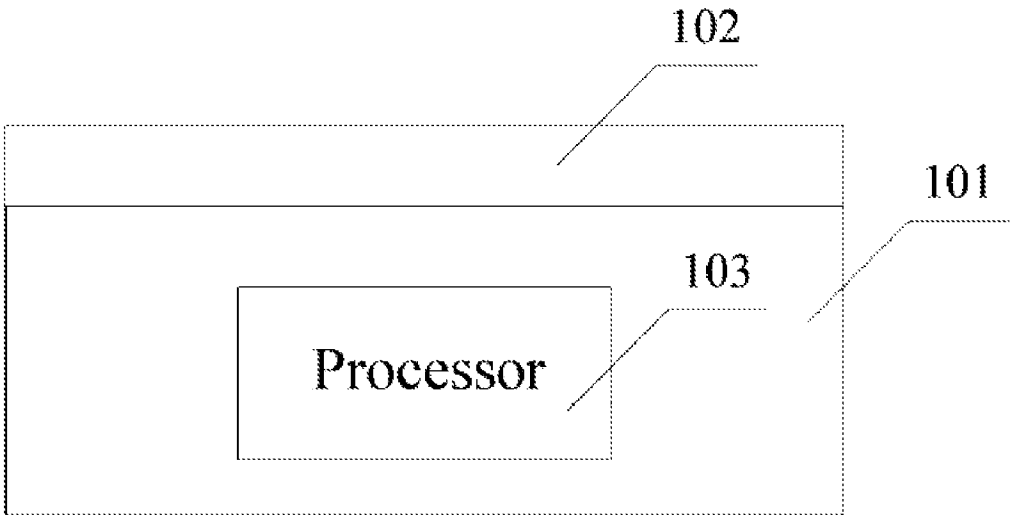
FIG. 1 is a schematic structural view of an electronic device embodiment 1.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

In an embodiment, an electronic device may solve the problem of users who cannot identify the content on the E-ink Display under low ambient light caused by the reflection principle adopted by the E-ink Display in the prior art.

To achieve such object, a technical solution is provided as follows: an electronic device which comprises: a body; an E-ink Display disposed on the body, the E-ink Display consists of at least one E-ink, any of the E-ink comprises an ink particle and an energy storage particle; a processor, connected to the E-ink Display, used for controlling the E-ink Display to display based on the E-ink in accordance with the content to be displayed; wherein, the energy storage particles are used for receiving and storing the energy of the ambient light when the ambient light intensity of the E-ink is greater than the first preset threshold, and releasing the stored energy when the ambient light intensity of the E-ink is smaller than the second preset threshold, the first preset threshold is not greater than the second preset threshold.

An embodiment may further comprise: a backlight source disposed between the body and the E-ink Display; wherein, when the backlight source is on, the brightness of the E-ink Display is higher than when the backlight source is off. The processor may further be used for controlling the backlight source to switch between the On and the Off state. An embodiment controlling the backlight source to switch from the Off state to the On state specifically comprises: testing the current brightness value of the E-ink Display; setting the brightness value of the backlight source in the On state according to the current brightness value so the brightness value of the backlight source is consistent with the current brightness value of the E-ink Display when the backlight source is switched to On state.

An embodiment further comprises: a first sensor, used for testing the energy stored by the energy storage particles in the E-ink Display to obtain the value of the energy stored by the E-ink Display; the processor, further used for determining whether the value of the energy stored by the E-ink Display is smaller than a preset third threshold to obtain the first determination result; turning on the backlight source when first determination result indicates that the value of the energy stored by the E-ink Display is smaller than the preset third threshold, and turning off the backlight source when the first determination result indicates that the value of the energy stored by the E-ink Display is greater than the preset third threshold.

An embodiment further comprises: a second sensor, used for testing the energy stored by energy storage particles in the E-ink Display to obtain the value of the energy stored by the E-ink Display and testing the ambient light intensity value of the E-ink Display; the processor, further used for determining whether the value of the energy stored by the E-ink Display is smaller than the preset third threshold to obtain the first determination result; determining whether the ambient light intensity value is smaller than a preset fourth threshold to obtain the second determination result; turning on the backlight source when the first determination result indicates that the value of the energy stored by the E-ink Display is smaller than the preset third threshold, and when the second determination result indicates that the ambient light intensity value is smaller than the preset fourth threshold.

An embodiment further comprises: an input unit which is used for receiving operating information, the operating information indicates that the operation body is operating in the preset input area of the electronic device; the processor, further used for analyzing whether the operating information is the first operation for switching the backlight source between the On and the Off state; adjusting the On and the Off state of the backlight source based on the analyzing result.

In an embodiment, a display method is applied to an electronic device with E-ink Display, the E-ink Display consists of at least one E-ink, any of the E-ink comprises ink particles and energy storage particles, the method comprises: controlling the E-ink Display to display based on the E-ink in accordance with the content to be displayed.

An embodiment further comprises: adjusting the On and the Off state of the backlight source of the electronic device according to the preset information; wherein, the backlight source is disposed between the body and the E-ink Display, when the backlight source is on, the brightness of the E-ink Display is higher than when the backlight source is off, and adjusting the On and the Off state of the backlight source of the electronic device according to the preset information comprises: testing the energy stored by energy storage particles in the E-ink Display to obtain the value of the energy stored by the E-ink Display; determining whether the value of the energy stored by the E-ink Display is smaller than a preset third threshold to obtain the first determination result; turning on the backlight source when first determination result indicates that the value of the energy stored by the E-ink Display is smaller than the preset third threshold, and turning off the backlight source when the first determination result indicates that the value of the energy stored by the E-ink Display is greater than the preset third threshold.

In an embodiment, adjusting the On and the Off state of the backlight source of the electronic device according to the preset information comprises: testing the energy stored by energy storage particles in the E-ink Display to obtain the value of the energy stored by the E-ink Display; testing the ambient light intensity value of the E-ink Display; determining whether the value of the energy stored by the E-ink Display is smaller than the preset third threshold to obtain the first determination result; determining whether the ambient light intensity value is smaller than a preset fourth threshold to obtain the second determination result; turning on the backlight source when the first determination result indicates that the value of the energy stored by the E-ink Display is smaller than the preset third threshold, and when the second determination result indicates that the ambient light intensity value is smaller than the preset fourth threshold.

In an embodiment, adjusting the On and the Off state of the backlight source of the electronic device according to the preset information comprises: receiving operating information, the operating information indicates that the operation body is operating in the preset input area of the electronic device; analyzing whether the operating information is the first operation for switching the backlight source between the On and the Off state; adjusting the On and the Off state of the backlight source based on the analyzing result.

Before controlling the backlight source to switch from the Off state to the On state, an embodiment comprises: testing the current brightness value of the E-ink Display; setting the brightness value of the backlight source in the On state according to the current brightness value; switch the backlight source to the On state from the Off state, the brightness value of the backlight source is consistent with the current brightness value of the E-ink Display.

In addition to the an embodiment, provides an E-ink Display solving the problem that the E-ink Display can only support simple colors and gray scales in the prior art. To achieve the above objective, an embodiment provides a technical solution such as: an E-ink Display, comprising: at least two compartment groups; each of the compartment groups comprises at least three compartments, the compartments are provided with ink particles, the color of the ink particles in any two compartments of the same compartment group are different, and based on the ink particles the pixel color of the compartment group can be adjusted.

In an embodiment, the E-ink Display mentioned above, wherein each of the compartment groups is provided with three compartments, the three compartments in the compartment group are respectively provided with one of the ink particles with three primary colors.

In an embodiment, the E-ink Display mentioned above may have electron affinity of any two colored ink particles of the ink particles with three primary colors is different.

In an embodiment, the E-ink Display mentioned above, wherein each of the compartment groups is provided with four compartments, the four compartments in the compartment group are respectively provided with one of the ink particles with three primary colors and the ink particles with the preset color.

In an embodiment, the E-ink Display mentioned above may have electron affinity of the ink particles with three primary colors is different from that of the ink particles with the preset color.

In an embodiment the E-ink Display mentioned above, wherein the arrangement order of the compartments provided with the ink color particles in any two compartment groups is the same.

In an embodiment, the E-ink Display mentioned above, wherein the compartments in the E-ink Display are arranged successively in a matrix arrangement mode.

In an embodiment, the E-ink Display mentioned above, wherein the compartments in the E-ink Display are arranged in a honeycomb arrangement mode.

Thus, an embodiment may comprise an electronic device, comprising: a main body; an E-ink Display provided on the main body, the E-ink Display comprises at least two compartment groups, each compartment group comprises at least three compartments, the compartments are provided with ink particles, the color of the ink particles in any two compartments of the same compartment group are different, and based on the ink particles the pixel color of the compartment group can be adjusted; and a processor connected to the E-ink Display for controlling the displaying of the image to be displayed on the E-ink Display based on the pixels of the E-ink Display.

In an embodiment, each of the compartment groups is provided with three compartments, the three compartments in the compartment group are respectively provided with one of the ink particles with three primary colors, and the electron affinity of any two colored ink particles of the ink particles with three primary colors is different, specifically, the processor is used for: acquiring each pixel information of the image to be displayed; analyzing the pixel information to acquire the tricolor value of each pixel; acquiring a first on-load voltage of the corresponding compartment group through calculation based on the tricolor value of the pixel; providing the voltage for the corresponding compartment group in the E-ink Display based on the first on-load voltage, so as to facilitate the ink particles with three primary colors to move under the effect of the voltage, and acquire the pixel color corresponding with the pixel information of the image to be displayed.

In an embodiment each of the compartment groups is provided with four compartments, the four compartments in the compartment group are respectively provided with one of the ink particles with three primary colors and the ink particles with the preset color, and the electron affinity of the ink particles with three primary colors is different from that of the ink particles with the preset color, specifically, the processor is used for: acquiring each pixel information of the image to be displayed; judging whether the pixel information is a color information to acquire a first judging result; characterizing the pixel information as color information based on the first judging result, analyzing the pixel information to acquire the tricolor value of each pixel; acquiring a second on-load voltage of the corresponding compartment group through calculation based on the tricolor value of the pixel; providing a voltage for the corresponding compartment group in the E-ink Display based on the second on-load voltage, so as to facilitate the ink particles with three primary colors and the ink particles with the preset color to move under the effect of the voltage, and acquire the pixel color corresponding with the pixel information of the image to be displayed; characterizing the pixel information as non-color information based on the first judging result, analyzing the pixel information to acquire the preset color information of each pixel; acquiring a third on-load voltage of the corresponding compartment group through calculation based on the preset color information of each pixel; providing a voltage for the corresponding compartment group in the E-ink Display based on the third on-load voltage, so as to facilitate the ink particles with three primary colors and the ink particles with the preset color to move under the effect of the voltage, and acquire the pixel color corresponding with the pixel information of the image to be displayed.

Thus, a technical solution is presented herein which solves the problem in the case of a very low ambient light users being unable to identify the content on the E-ink Display for its low brightness, and E-ink Display only supporting simple colors and gray scales, thereby leading to a poor user experience.

Thus, through the technical solution mentioned above, comparing with the prior art, a present embodiment provides an electronic device, comprising: a body; an E-ink Display disposed on the body, the E-ink Display consists of at least one E-ink, any of the E-ink comprises ink particles and energy storage particles; a processor connected to the E-ink Display, used for controlling the E-ink Display to display based on the E-ink in accordance with the content to be displayed; wherein, the energy storage particles are used for receiving and storing the energy of the ambient light when the ambient light intensity of the E-ink is greater than the first preset threshold, and releasing the stored energy when the ambient light intensity of the E-ink is smaller than the second preset threshold. In this electronic device, energy storage particles are added into the E-ink of the E-ink Display for storing the energy when the ambient light intensity of the E-ink is high and releasing the energy when the ambient light intensity of the E-ink is low to increase the overall brightness of this E-ink Display, enabling the users to identify the content on the E-ink Display.

Thus, through the technical solution, comparing with the prior art, an embodiment provides an E-ink Display, comprising: at least two compartment groups; each compartment group comprises at least three compartments, the compartments are provided with ink particles, the color of the ink particles in any two compartments of the same compartment group are different, and based on the ink particles the pixel color of the compartment group can be adjusted. The E-ink Display is provided with a plurality of compartment groups, each compartment group comprises at least three compartments. The compartments are provided with ink particles with various colors and each compartment corresponds to a pixel. Based on the ink particles the pixel color of the compartment group can be adjusted and the compartments in the E-ink Display constitute a massive quantity of pixels, which can realize the displaying of the images to be displayed and because the compartments are provided with ink particles with different colors, a rich color display is achieved, thereby improving the user experience.

For better and detailed understanding of the features and technical content, example embodiments are illustrated in detail with reference to the accompanying drawings. The accompanying drawings are merely for illustration and reference, but are not intended to limit the scope of the claims.

The technical solution of an embodiment is described expressly and completely as follows with reference to the accompanying drawings. It is clear that the embodiments described are not all but only some of the embodiments. All other embodiments obtained based on the embodiments by those of ordinary skill in the art without creative work fall within the scope of the present invention.

See FIG. 1, which is a schematic structural view of an electronic device embodiment 1, the schematic structural view is a side view. The electronic device can be an electronic device varying from desktop computer, notebook computer, tablet computer, mobile phone, smart TV, smart watch to wearable device.

In an embodiment, the electronic device comprises: a body 101, an E-ink Display 102 and a processor 103; wherein, the E-ink Display 102 is disposed on the body 101, the E-ink Display consists of at least one E-ink, any of the E-ink comprises ink particles and energy storage particles. Note that the E-ink Display can be disposed on one or even more sides on the body 101; the present application has no limits on the specific location for setting the E-ink Display.

In an embodiment, the processor 103, connected to the E-ink Display 102, used for controlling the E-ink Display to display based on the E-ink in accordance with the content to be displayed; wherein, the E-ink Display has a plurality of E-inks in, the E-inks are arranged in array mode.

Particularly, the arrangement mode of the E-inks can be the matrix arrangement mode or the honeycomb arrangement mode, wherein, the energy storage particles are the particles with energy storage function, the energy storage particles can absorb the light energy of the ambient light with the presence of ambient light and store it in the lattices of the substance. In the case of a very low ambient light or lack of ambient light, the substance can release part of the stored light energy naturally, thereby producing a luminous effect.

For example, zinc sulfide ($Z_nS$) particles can be adopted as the energy storage particles. Note that adopting zinc sulfide particles as the energy storage particles proposed in this embodiment is for example only and there are no limits on the material type for the energy storage particles.

In an embodiment, the processor 103, connected to the E-ink Display 102, is used for controlling the E-ink Display to display based on the E-ink in accordance with the content to be displayed. Note that there are ink particles in the E-ink of the E-ink Display, the ink particles have a certain electrophilicity which enables them to move under the effect of the electric field.

Particularly, the processor applies corresponding electric field to each E-ink in the E-ink Display to control the corresponding movement of the ink particles in the E-ink, making the E-ink Display displaying the content to be displayed.

Figure 2:
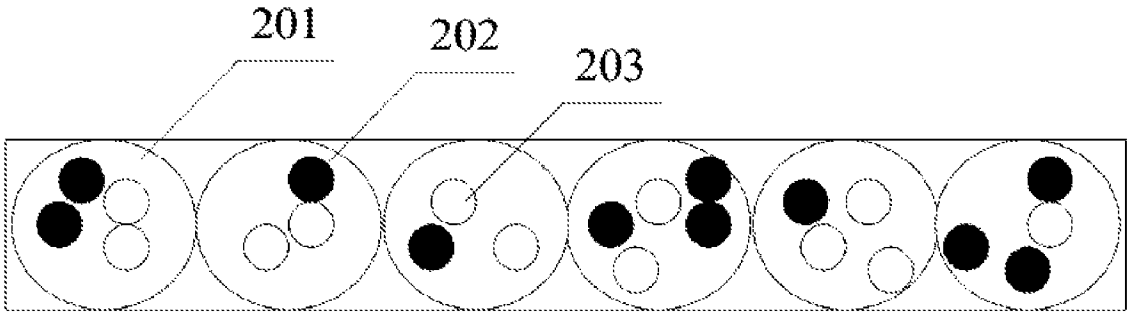
FIG. 2 is schematic structural view of the E-ink Display in an electronic device embodiment 1.

As shown in FIG. 2, it is the schematic structural view of the E-ink Display in this electronic device embodiment 1, the schematic structural view is a side view, the round structure 201 in the figure represents the E-ink, the black particles 202 represent the ink particles and the white particles 203 represent the energy storage particles.

In an embodiment, the energy storage particles are used for receiving and storing the energy of the ambient light when the ambient light intensity of the E-ink is greater than the first preset threshold, and releasing the stored energy when the ambient light intensity of the E-ink is smaller than the second preset threshold, the first preset threshold is not greater than the second preset threshold.

Note that the shape of the E-ink is not limited to the round shapes shown in FIG. 2, it can be other shapes such as columnar structure, oval or cone structure, the present application has no limits on the shape of the E-ink. Also, note that the present application has no limits on the numbers of ink particles and energy storage particles for any of the E-inks.

In an embodiment, the ambient light of the E-ink may comprise: the backlight condition of the electronic device and the external ambient light of the E-ink Display. Particularly, the backlight condition of the electronic device refers to whether the backlight source of the electronic device is on or not, the backlight source is the light source adopted when the display of the electronic device is tuned on.

In an embodiment, the external ambient light of the E-ink Display refers to the ambient light outside the electronic device such as the outdoor ambient light or indoor ambient light. Note that the value for the first preset threshold and the second preset threshold relates on the properties of the energy storage particles themselves. Particularly, in the case that different materials were adopted for the energy storage particles, the corresponding first preset threshold and the second preset threshold may also be different.

For the E-ink Display according to an embodiment, the energy storage particles receive and store the energy of the ambient light when the ambient light intensity is high, thus in the scene, due to the ambient light intensity being high enough, the brightness of the energy storage particles being lower than the ambient light, and the users are able to view the content displayed on the E-ink Display counting on the ambient light only. When the ambient light intensity is low, the energy storage particles can release the energy stored therein to achieve a luminous effect, improving the overall brightness of this E-ink Display. The users can also view the content displayed on the E-ink Display counting on the luminous effect achieved by the energy storage particles without turning on the backlight of the electronic device, thereby saving the power consumption of the electronic device.

In conclusion, an embodiment provides an electronic device, wherein comprising: a body; an E-ink Display disposed on the body, the E-ink Display consists of at least one E-ink, any of the E-ink comprises ink particles and energy storage particles; a processor, connected to the E-ink Display, used for controlling the E-ink Display to display based on the E-ink in accordance with the content to be displayed; wherein, the energy storage particles are used for receiving and storing the energy of the ambient light when the ambient light intensity of the E-ink is greater than the first preset threshold, and releasing the stored energy when the ambient light intensity of the E-ink is smaller than the second preset threshold. In the electronic device, energy storage particles are added into the E-ink of the E-ink Display for storing the energy when the ambient light intensity of the E-ink is high and releasing the energy when the ambient light intensity of the E-ink is low to increase the overall brightness of this E-ink Display, enabling the users to identify the content on the E-ink Display.

Figure 3:
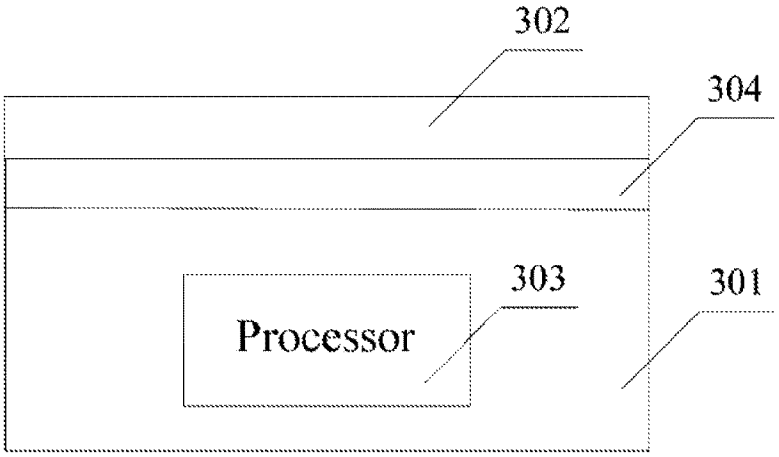
FIG. 3 is a schematic structural view of an electronic device embodiment 2.

See FIG. 3, it is a schematic structural view of an electronic device embodiment 2, the electronic device comprises: a body 301, an E-ink Display 302, a processor 303 and a backlight source 304; wherein, the body 301, E-ink Display 302 and processor 303 have the same structure and function with the corresponding ones in embodiment 1, therefore no redundant descriptions are comprised in this embodiment. In an embodiment, the backlight source 304 is disposed between the body and the E-ink Display;

FIG. 3 represents the backlight source 304 in a hierarchy structure, however it is not limited to this, in specific implementations, the backlight source can be the light source hierarchy structure consisting of several light spots, other light source structures can also be adopted and there are no limits on it in this embodiment.

In an embodiment, when the backlight source is on, the brightness of the E-ink Display is higher than when the backlight source is off. Particularly, the energy storage particles in the E-ink Display contain a high level of energy, in the case that the electronic device is in a dark environment, the energy storage particles can release the energy to improve the overall brightness of the E-ink Display, thus reducing the power consumption of the electronic device, wherein the backlight source is not required to be turned on and the content on the E-ink Display can be identified counting on the energy released from the energy storage particles in the E-ink Display.

In an embodiment, the energy storage particles released a lot of energy and contain a low level of energy. Thus, in the case that the electronic device is in a dark environment, the energy storage particles cannot release enough energy to improve the overall brightness of the E-ink Display, the backlight source is required to be turned on to identify the content on the E-ink Display on the basis of the light from the backlight source.

In an embodiment, the processor is further used for controlling the backlight source to switch between the On and the Off state, wherein, the processor can control the switching for backlight source automatically on the basis of the operation actions for users or the preset conditions.

As a specific example, a key (virtual or physical) can be disposed in the electronic device, by pressing the key, users are able to turn on or turn off the backlight source manually, detailed description on this will be given in the subsequent embodiment while no detailed description given in this embodiment.

As a specific example, the preset conditions for switching between the On and the Off state for the backlight source automatically can be set in the electronic device, detailed description on this will be given in the subsequent embodiment while no detailed description given in this embodiment.

Particularly, the processor controlling the backlight source to switch from the Off state to the On state, the specific process comprising: S1: testing the current brightness value of the E-ink Display; S2: setting the brightness value of the backlight source in the On state according to the current brightness value so the brightness value of the backlight source is consistent with the current brightness value of the E-ink Display when the backlight source is switched to the On state.

In specific implementations, the current brightness value of the E-ink Display can be obtained by testing on the basis of the light sensor set in the electronic device. Note that when the backlight source switched into the On state from the Off state, its initial brightness value is the same as the brightness value of the E-ink Display achieved on the basis of releasing energy by the energy storage particles. Once the switching is done, there is no change on the brightness value of the E-ink Display and no case of the E-ink Display directly switching from darker to lighter is apparent. The eyes of users are adapted to the switching of light source between energy storage particles and backlight source without the dazzling feeling, thereby the user experience is improved.

Note that once the backlight source is turned on, during the process of subsequent use, the brightness of the backlight can also be adjusted on the basis of the operation actions for users or the preset conditions automatically.

In conclusion, this embodiment provides an electronic device, characterized in that: further comprising: a backlight source disposed between the body and the E-ink Display; wherein, when the backlight source is on, the brightness of the E-ink Display is higher than when the backlight source is off. The backlight source used for replenishing brightness for the E-ink Display, further disposed in the electronic device, thereby in the case that energy storage particles contain a low level of energy, the E-ink Display will be lightened on the basis of the backlight source to improve the overall brightness of the E-ink Display, enabling the users to identify the content on the E-ink Display, thereby the user experience is improved.

Figure 4:
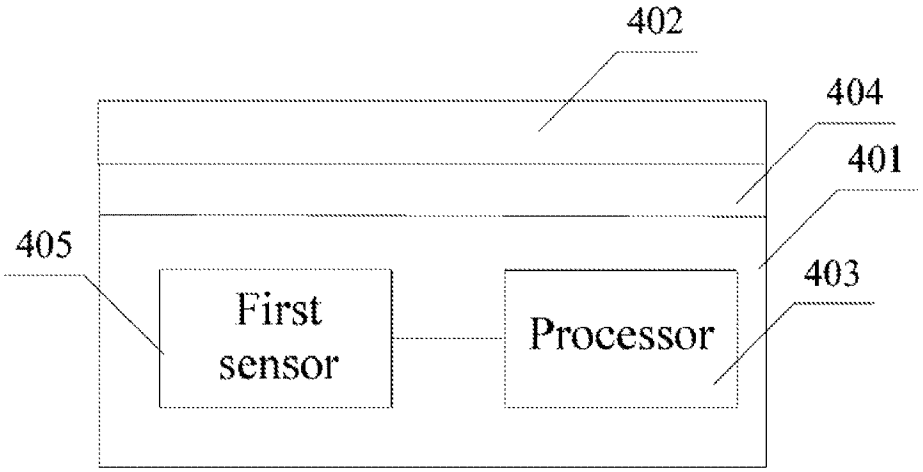
FIG. 4 is a schematic structural view of an electronic device embodiment 3.

See FIG. 4, it is a schematic structural view of an electronic device embodiment 3, the electronic device comprises: a body 401, an E-ink Display 402, a processor 403, a backlight source 404 and a first sensor 405. In an embodiment, the first sensor 405 is used for testing the energy stored by energy storage particles in the E-ink Display to obtain the value of the energy stored by the E-ink Display.

The processor 403 is further used for determining whether the value of the energy stored by the E-ink Display is smaller than a preset third threshold to obtain the first determination result; turning on the backlight source when first determination result indicates that the value of the energy stored by the E-ink Display is smaller than the preset third threshold, and turning off the backlight source when the first determination result indicates that the value of the energy stored by the E-ink Display is greater than the preset third threshold.

Particularly, the light sensor can be adopted as the first sensor, which is able to test the energy value in the energy storage particles in the E-ink Display to obtain the value of the energy stored in the E-ink Display. Note that there is a corresponding relation between the value of the energy stored in the E-ink Display and the brightness value, when the value of the energy stored is large, the energy storage particles release energy and provide a high brightness value; otherwise, the energy storage particles release energy and provide a low brightness value.

In an embodiment, a third threshold is set in the processor. In the case that the value of the energy stored in the E-ink Display is greater than the third threshold, the energy storage particles can provide a high brightness value. In the case that the value of the energy stored in the E-ink Display is smaller than the third threshold, the energy storage particles can provide a low brightness value, the low brightness value cannot support the users to identify the content on the E-ink Display.

Particularly, based on the energy stored by energy storage particles in the E-ink Display obtained through testing, it is possible to determine whether the brightness value of the E-ink Display can support users for identifying the content on the E-ink Display. In the case that the value of the energy stored in the E-ink Display is smaller than the third threshold, the energy released by the energy storage particles provides a low brightness value which cannot support the users to identify the content on the E-ink Display, thus the backlight source is turned on under control to lighten the E-ink Display for users to identify the content on it. Meanwhile, it provides the light source for the energy storage particles in the E-ink Display, enabling them to receive and store the energy of the backlight source. In the case that the value of the energy stored in the E-ink Display is greater than the third threshold, the energy released by the energy storage particles provides a high brightness value which can support the users to identify the content on the E-ink Display, thus the backlight source can be turned off under control to make the energy storage particles releasing energy to lighten the E-ink Display, supporting the users to identify the content on the E-ink Display.

In conclusion, the embodiment provides an electronic device, characterized in that: further comprises: a first sensor, used for testing the energy stored by energy storage particles in the E-ink Display to obtain the value of the energy stored by the E-ink Display; the processor, further used for determining whether the value of the energy stored by the E-ink Display is smaller than a preset third threshold to obtain the first determination result. Turning on the backlight source when first determination result indicates that the value of the energy stored by the E-ink Display is smaller than the preset third threshold, and turning off the backlight source when the first determination result indicates that the value of the energy stored by the E-ink Display is greater than the preset third threshold. The electronic device, wherein the energy is stored on the basis of the energy storage particles in the E-ink Display and turning on or turning off the backlight source automatically without the need for manual control by the users, simplifies the operation and improves the user experience.

Figure 5:
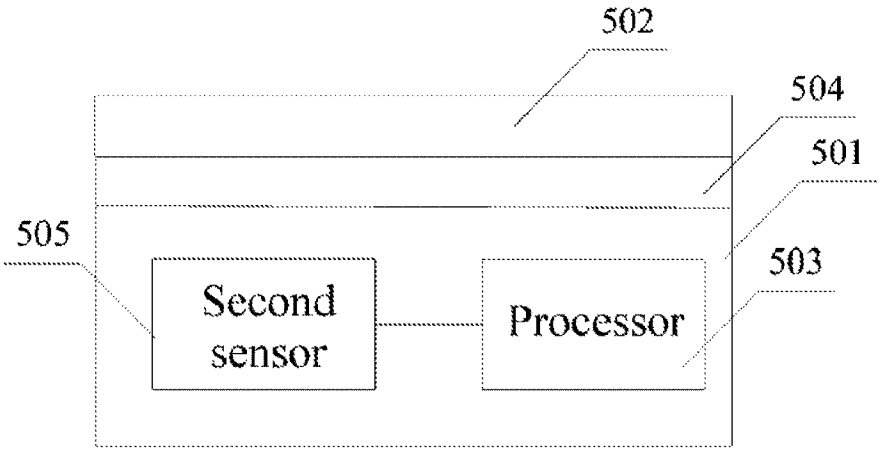
FIG. 5 is a schematic structural view of an electronic device embodiment 4.

See FIG. 5, it is a schematic structural view of an electronic device embodiment 4, the electronic device comprises: a body 501, an E-ink Display 502, a processor 503, a backlight source 504 and a second sensor 505; the second sensor 505, used for testing the energy stored by energy storage particles in the E-ink Display to obtain the value of the energy stored by the E-ink Display and testing the ambient light intensity value of the E-ink Display; the processor 503, further used for determining whether the value of the energy stored by the E-ink Display is smaller than the preset third threshold to obtain the first determination result; determining whether the ambient light intensity value is smaller than a preset fourth threshold to obtain the second determination result; turning on the backlight source when the first determination result indicates that the value of the energy stored by the E-ink Display is smaller than the preset third threshold, and when the second determination result indicates that the ambient light intensity value is smaller than the preset fourth threshold.

Particularly, the light sensor can be adopted as the second sensor, which is able to test the energy value in the energy storage particles in the E-ink Display to obtain the value of the energy stored in the E-ink Display; also, it can test the ambient light intensity of the E-ink Display. Note that there is a corresponding relation between the value of the energy stored in the E-ink Display and the brightness value, when the value of the energy stored is large, the energy storage particles release energy and provide a high brightness value; otherwise, the energy storage particles release energy and provide a low brightness value.

In an embodiment, a third threshold is set in the processor, in the case that the value of the energy stored in the E-ink Display is greater than the third threshold, the energy storage particles can provide a high brightness value. In the case that the value of the energy stored in the E-ink Display is smaller than the third threshold, the energy storage particles can provide a low brightness value, the low brightness value cannot support the users to identify the content on the E-ink Display.

Note that in the case that the ambient light intensity of the E-ink Display is greater than the fourth threshold, the users can identify the content on the E-ink Display on the basis of the ambient light. In the case that the ambient light intensity of the E-ink Display is smaller than the fourth threshold, the users need to identify the content on the E-ink Display on the basis of the light provided by the E-ink Display. Note that there is no necessary connection between the value for third threshold and for the fourth threshold, which respectively refers to energy value and light intensity value.

Note that in specific implementations, it is possible to determine the ambient light intensity value obtained as smaller than the fourth threshold once the value of the energy stored in the E-ink Display is determined as smaller than the third threshold, and then executing the control steps for turning on the backlight source. Otherwise, in the case that the value of the energy stored in the E-ink Display is determined as smaller than the third threshold, when the ambient light intensity value is greater than the fourth threshold, the ambient light supports the users for identifying the content on the E-ink Display meanwhile provides the light source for the energy storage particles in the E-ink Display, enabling the energy storage particles to receive and store the energy of the backlight source;

It is possible to determine the value of the energy stored in the E-ink Display as smaller than the third threshold once the ambient light intensity value obtained is determined as smaller than the fourth threshold, and then executing the control steps for turning on the backlight source. Otherwise, in the case that the ambient light intensity value obtained is determined as smaller than the fourth threshold and the value of the energy stored in the E-ink Display is greater than the third threshold, the energy storage particles in the E-ink Display can provide a high enough light intensity value to support the users for identifying the content on the E-ink Display.

In conclusion, the embodiment provides an electronic device, characterized in that: further comprises: a second sensor, used for testing the energy stored by energy storage particles in the E-ink Display to obtain the value of the energy stored by the E-ink Display and testing the ambient light intensity value of the E-ink Display; the processor, further used for determining whether the value of the energy stored by the E-ink Display is smaller than the preset third threshold to obtain the first determination result; determining whether the ambient light intensity value is smaller than a preset fourth threshold to obtain the second determination result; turning on the backlight source when the first determination result indicates that the value of the energy stored by the E-ink Display is smaller than the preset third threshold, and when the second determination result indicates that the ambient light intensity value is smaller than the preset fourth threshold. The electronic device, wherein the energy and the ambient light conditions are stored on the basis of the energy storage particles in the E-ink Display, and turning on or turning off the backlight source automatically without the need for manual control by the users, simplifies the operation and improves the user experience, and wherein, the processor can also switch the backlight source on the basis of the user's operation.

Figure 6:
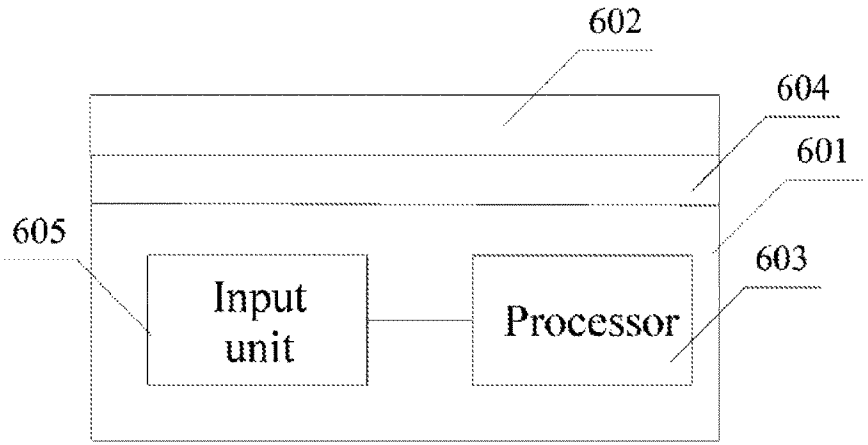
FIG. 6 is a schematic structural view of an electronic device embodiment 5.

See FIG. 6, it is a schematic structural view of an electronic device embodiment 4. The electronic device comprises: a body 601, an E-ink Display 602, a processor 603, a backlight source 604 and an input unit 605; an input unit 605, used for receiving operating information, the operating information indicates that the operation body is operating in the preset input area of the electronic device; the processor 603, further used for analyzing whether the operating information is the first operation for switching the backlight source between the On and the Off state; Adjusting the On and the Off state of the backlight source based on the analyzing result.

In an embodiment, the input area used for switching between the On and the Off state for the backlight source can also be provided in the electronic device, specifically, the input area can be physical key of the electronic device or the virtual key in the touch screen of the electronic device.

Particularly, in the case that the key for turning on the backlight source and the key for turning off the backlight source is a reusable key, the processor controls the switching of the state for the backlight source on the basis of the current condition for the E-ink Display and the operation of pressing the key;

Particularly, in the case that the key for turning on the backlight source and the key for turning off the backlight source are mutually independent function keys, the processor controls adjusting of the state for the backlight source on the basis of the function for the triggered key only.

In conclusion, the embodiment provides an electronic device, characterized in that: further comprises: an input unit, used for receiving operating information, the operating information indicates that the operation body is operating in the preset input area of the electronic device; the processor, further used for analyzing whether the operating information is the first operation for switching the backlight source between the On and the Off state; adjusting the On and the Off state of the backlight source based on the analyzing result. A preset input area for manual control of the backlight source for users is provided in the electronic device, enabling users to control the backlight source on the basis of their own experiences, which brings a high user engagement and improves the user experience.

The electronic device is described in detail in the embodiment above, there are multiple forms of methods for realizing the electronic device, therefore, a display method used for the electronic device, and the specific embodiment is explained in detail below.

Turning now to a display method embodiment 1, wherein the method is applied to an electronic device with E-ink Display. The electronic device can be an electronic device varying from desktop computer, notebook computer, tablet computer, mobile phone, smart TV, smart watch to wearable device, wherein, the E-ink Display consists of at least one E-ink, any of the E-ink comprises ink particles and energy storage particles.

In an embodiment, the method comprises the following steps: controlling the E-ink Display to display based on the E-ink in accordance with the content to be displayed, wherein there are ink particles in the E-ink of the E-ink Display, the ink particles have a certain electrophilicity which enables them to move under the effect of the electric field.

Particularly, corresponding voltage is applied on the E-ink Display on the basis of the content to be displayed to make the ink particles in the E-ink move accordingly, thereby getting the content to be displayed.

Meanwhile, as energy storage particles are comprised in the E-ink, the energy storage particles are the particles with energy storage function, the energy storage particles can absorb the light energy of the ambient light with the presence of ambient light and store it in the lattices of the substance. In the case of a very low ambient light or lack of ambient light, the substance can release part of the stored light energy naturally, thereby producing a luminous effect. The energy released by the energy storage particles can also be based on while the E-ink Display is displaying the content.

For the E-ink Display according to this embodiment, the energy storage particles receive and store the energy of the ambient light when the ambient light intensity is high, thus in the scene, due to the ambient light intensity being high enough, the brightness of the energy storage particles is lower than the ambient light, and the users are able to view the content displayed on the E-ink Display counting on the ambient light only. When the ambient light intensity is low, the energy storage particles can release the energy stored thereof to achieve the luminous effect, improving the overall brightness of this E-ink Display. The users can also view the content displayed on the E-ink Display counting on the luminous effect achieved by the energy storage particles without turning on the backlight of the electronic device, thereby saving the power consumption of the electronic device.

In conclusion, the embodiment provides a display method, wherein the content to be displayed can be displayed on the basis of the ink particles in the E-ink Display. Meanwhile, as the energy storage particles are added into the E-ink of the E-ink Display for storing the energy when the ambient light intensity of the E-ink is high and releasing the energy when the ambient light intensity of the E-ink is low to increase the overall brightness of this E-ink Display, enabling the users to identify the content on the E-ink Display.

Figure 7:
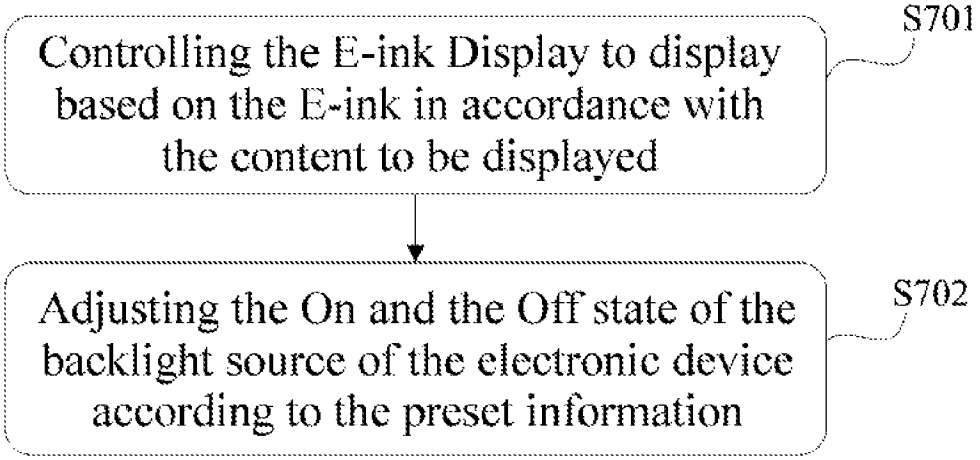
FIG. 7 is a flow chart of a display method embodiment 2.

See FIG. 7, it is a flow-chart of a display method embodiment 2, the method comprises the following steps: step S701: controlling the E-ink Display to display based on the E-ink in accordance with the content to be displayed; step S702: adjusting the On and the Off state of the backlight source of the electronic device according to the preset information.

In an embodiment, the backlight source is disposed between the body and the E-ink Display, when the backlight source is on, the brightness of the E-ink Display is higher than when the backlight source is off.

Particularly, the energy storage particles in the E-ink Display contain a high level of energy, in the case that the electronic device is in a dark environment. The energy storage particles can release the energy to improve the overall brightness of the E-ink Display, thereby reducing the power consumption of the electronic device. Thus, the backlight source is not required to be turned on and the content on the E-ink Display can be identified counting on the energy released from the energy storage particles in the E-ink Display.

In an embodiment, the energy storage particles released a lot of energy and contain a low level of energy. Thus, in the case that the electronic device is in a dark environment, the energy storage particles cannot release enough energy to improve the overall brightness of the E-ink Display, the backlight source is required to be turned on to identify the content on the E-ink Display on the basis of the light from the backlight source.

In an embodiment, the switching for backlight source can be controlled automatically on the basis of the operation actions for users or the preset conditions. Note that the sequence for step S701 and 702 is not limited in the present application; they can be executed concurrently or be executed with the exchanged sequence.

In conclusion, the embodiment provides a display method, further comprising: adjusting the On and the Off state of the backlight source of the electronic device according to the preset information. Adopting this method on the basis of controlling the backlight source for replenishing brightness for the E-ink Display, thereby in the case that energy storage particles contain a low level of energy, the E-ink Display will be lightened on the basis of the backlight source to improve the overall brightness of the E-ink Display, enabling the users to identify the content on the E-ink Display, thereby the user experience is improved.

Figure 8:
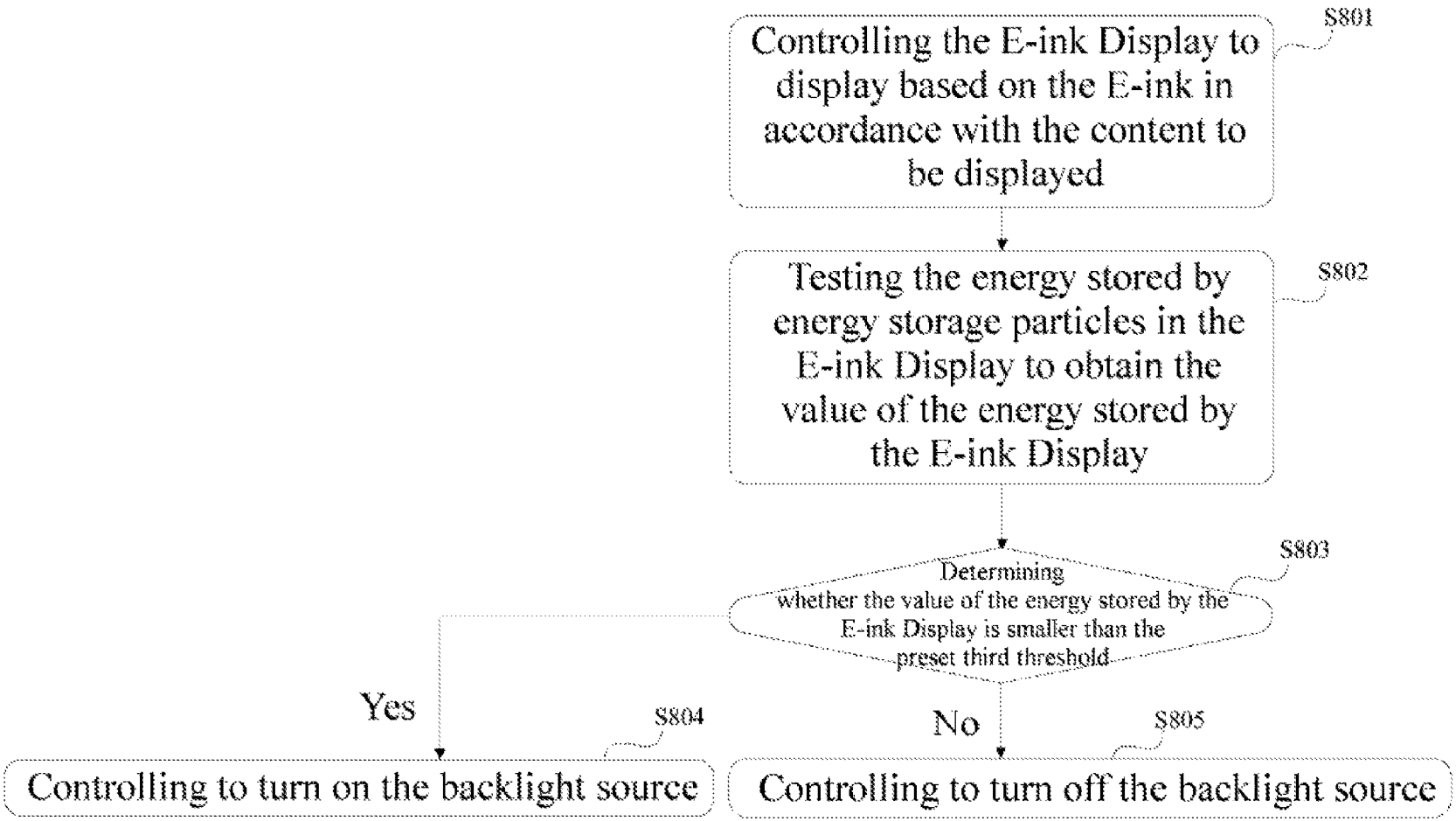
FIG. 8 is a flow chart of a display method embodiment 3.

See FIG. 8, it is a flow chart of a display method embodiment 3; the method comprises the following steps. Step S801: controlling the E-ink Display to display based on the E-ink in accordance with the content to be displayed; wherein, step S801 is the same with step S701 in embodiment 2, therefore no redundant descriptions are comprised in this embodiment.

Step S802: testing the energy stored by energy storage particles in the E-ink Display to obtain the value of the energy stored by the E-ink Display; wherein, there is a corresponding relation between the value of the energy stored in the E-ink Display and the brightness value. When the value of the energy stored is large, the energy storage particles release energy and provide a high brightness value; otherwise, the energy storage particles release energy and provide a low brightness value.

Step S803: determining whether the value of the energy stored by the E-ink Display is smaller than the preset third threshold to obtain the first determination result; and wherein, in the case that the value of the energy stored in the E-ink Display is greater than the third threshold, the energy storage particles can provide a high brightness value. In the case that the value of the energy stored in the E-ink Display is smaller than the third threshold, the energy storage particles can provide a low brightness value, the low brightness value cannot support the users to identify the content on the E-ink Display.

Step S804: when the first determination result indicates that the value of the energy stored by the E-ink Display represented is smaller than the preset third threshold, turn on the backlight source.

Step S805: when the first determination result indicates that the value of the energy stored by the E-ink Display is greater than the preset third threshold, turn off the backlight source.

In an embodiment, basing on the energy stored by energy storage particles in the E-ink Display obtained through testing, it is possible to determine whether the brightness value of the E-ink Display can support users for identifying the content on the E-ink Display. In the case that the value of the energy stored in the E-ink Display is smaller than the third threshold, the energy released by the energy storage particles provides a low brightness value which cannot support the users to identify the content on the E-ink Display. Thereby the backlight source is turned on under control to lighten the E-ink Display for users to identify the content on it. Meanwhile, it provides the light source for the energy storage particles in the E-ink Display, enabling them to receive and store the energy of the backlight source. In the case that the value of the energy stored in the E-ink Display is greater than the third threshold, the energy released by the energy storage particles provides a high brightness value which can support the users to identify the content on the E-ink Display. Thus, the backlight source can be turned off under control to make the energy storage particles releasing energy to lighten the E-ink Display, supporting the users to identify the content on the E-ink Display.

In conclusion, the embodiment provides a display method, comprising: testing the energy stored by energy storage particles in the E-ink Display to obtain the value of the energy stored by the E-ink Display; determining whether the value of the energy stored by the E-ink Display is smaller than a preset third threshold to obtain the first determination result; turning on the backlight source when first determination result indicates that the value of the energy stored by the E-ink Display is smaller than the preset third threshold, and turning off the backlight source when the first determination result indicates that the value of the energy stored by the E-ink Display is greater than the preset third threshold. Adopting this method, the energy is stored on the basis of the energy storage particles in the E-ink Display while turning on or turning off the backlight source automatically without the need for manual control by the users, simplifies the operation and improves the user experience.

Figure 9:
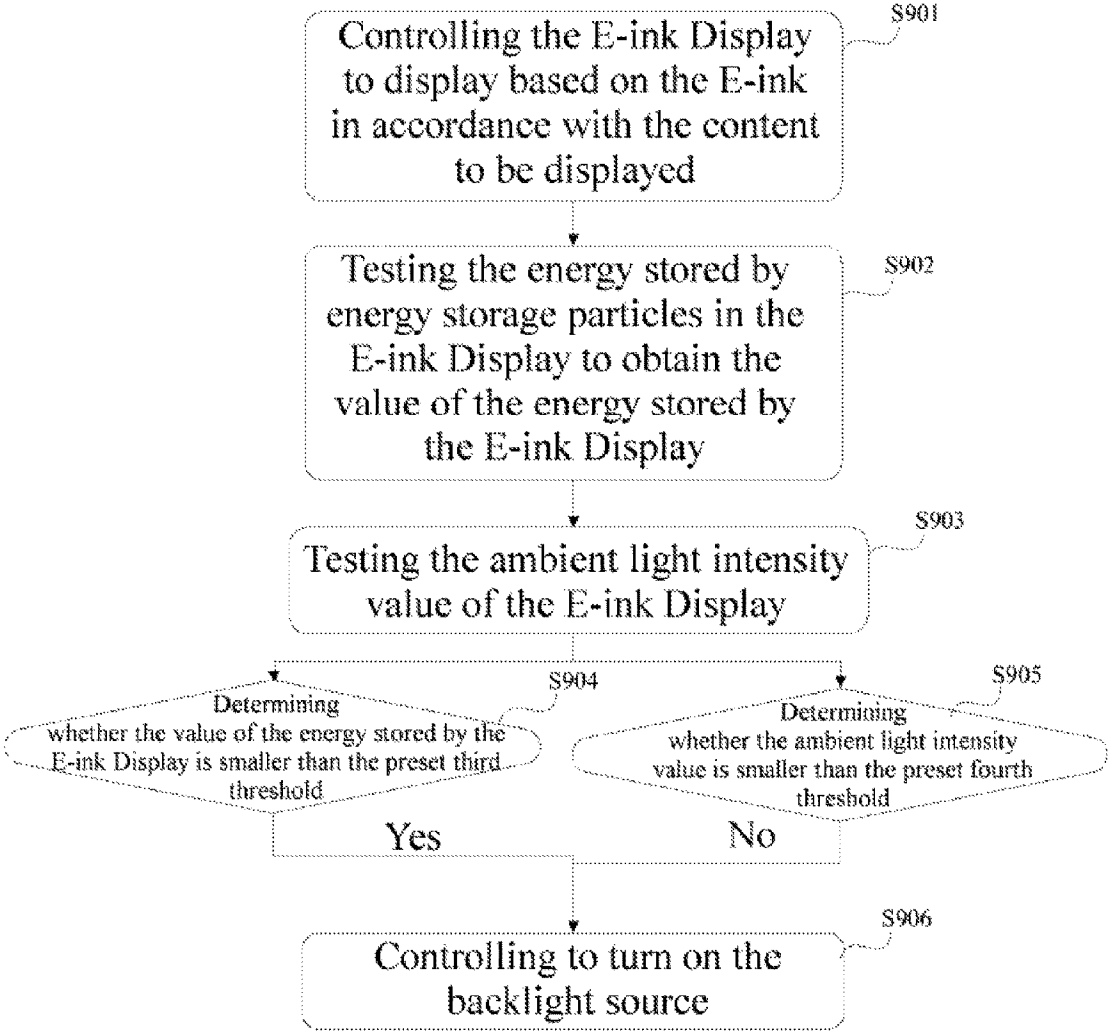
FIG. 9 is a flow chart of a display method embodiment 4.

See FIG. 9, it is a flow chart of a display method embodiment 4; the method comprises the following steps. Step S901: controlling the E-ink Display to display based on the E-ink in accordance with the content to be displayed; wherein, step S901 is the same with step S701 in embodiment 2, therefore no redundant descriptions are comprised in this embodiment.

Step S902: testing the energy stored by energy storage particles in the E-ink Display to obtain the value of the energy stored by the E-ink Display. Note that there is a corresponding relation between the value of the energy stored in the E-ink Display and the brightness value, when the value of the energy stored is large, the energy storage particles release energy and provide a high brightness value; otherwise, the energy storage particles release energy and provide a low brightness value.

Step S903: testing the ambient light intensity value of the E-ink Display, wherein, the ambient light intensity value is related to the possibility for users to identify the content on the E-ink Display on the basis of the ambient light. In an embodiment, the light sensor can be adopted for testing the energy value in the energy storage particles in the E-ink Display to obtain the value of the energy stored in the E-ink Display; and testing the ambient light intensity of the E-ink Display.

Step S904: determining whether the value of the energy stored by the E-ink Display is smaller than the preset third threshold to obtain the first determination result, wherein, in the case that the value of the energy stored in the E-ink Display is greater than the third threshold, the energy storage particles can provide a high brightness value. In the case that the value of the energy stored in the E-ink Display is smaller than the third threshold, the energy storage particles can provide a low brightness value, the low brightness value cannot support the users to identify the content on the E-ink Display.

Step S905: determining whether the ambient light intensity value is smaller than the preset fourth threshold to obtain the second determination result. In an embodiment, in the case that the ambient light intensity of the E-ink Display is greater than the fourth threshold, the users can identify the content on the E-ink Display on the basis of the ambient light; in the case that the ambient light intensity of the E-ink Display is smaller than the fourth threshold, the users need to identify the content on the E-ink Display on the basis of the light provided by the E-ink Display.

Step S906: when the value of the energy stored by the E-ink Display represented on the basis of the first determination result is smaller than the preset third threshold, and the ambient light intensity value represented on the basis of the second determination result is smaller than the preset fourth threshold, it controls turning on the backlight source. Note that there are no limits on the sequence for step S904 and S905 in the present application.

In an embodiment, it is possible to determine the ambient light intensity value obtained as smaller than the fourth threshold once the value of the energy stored in the E-ink Display is determined as smaller than the third threshold, and then executing the control steps for turning on the backlight source. Otherwise, in the case that value of the energy stored in the E-ink Display is determined as smaller than the third threshold, when the ambient light intensity value is greater than the fourth threshold, the ambient light supports the users for identifying the content on the E-ink Display. Meanwhile, an embodiment provides the light source for the energy storage particles in the E-ink Display, enabling the energy storage particles to receive and store the energy of the backlight source;

It is possible to determine the value of the energy stored in the E-ink Display as smaller than the third threshold once the ambient light intensity value obtained is determined as smaller than the fourth threshold, and then executing the control steps for turning on the backlight source. Otherwise, in the case that the ambient light intensity value obtained is determined as smaller than the fourth threshold and the value of the energy stored in the E-ink Display is greater than the third threshold, the energy storage particles in the E-ink Display can provide a high enough light intensity value to support the users for identifying the content on the E-ink Display.

In conclusion, this embodiment provides a display method, comprising: testing the energy stored by energy storage particles in the E-ink Display to obtain the value of the energy stored by the E-ink Display; testing the ambient light intensity value of the E-ink Display; determining whether the value of the energy stored by the E-ink Display is smaller than the preset third threshold to obtain the first determination result; determining whether the ambient light intensity value is smaller than a preset fourth threshold to obtain the second determination result; turning on the backlight source when the first determination result indicates that the value of the energy stored by the E-ink Display is smaller than the preset third threshold, and when the second determination result indicates that the ambient light intensity value is smaller than the preset fourth threshold. Adopting this method, the energy and the ambient light conditions are stored on the basis of the energy storage particles in the E-ink Display, and turning on or turning off the backlight source automatically without the need for manual control by the users, simplifies the operation and improves the user experience.

Figure 10:
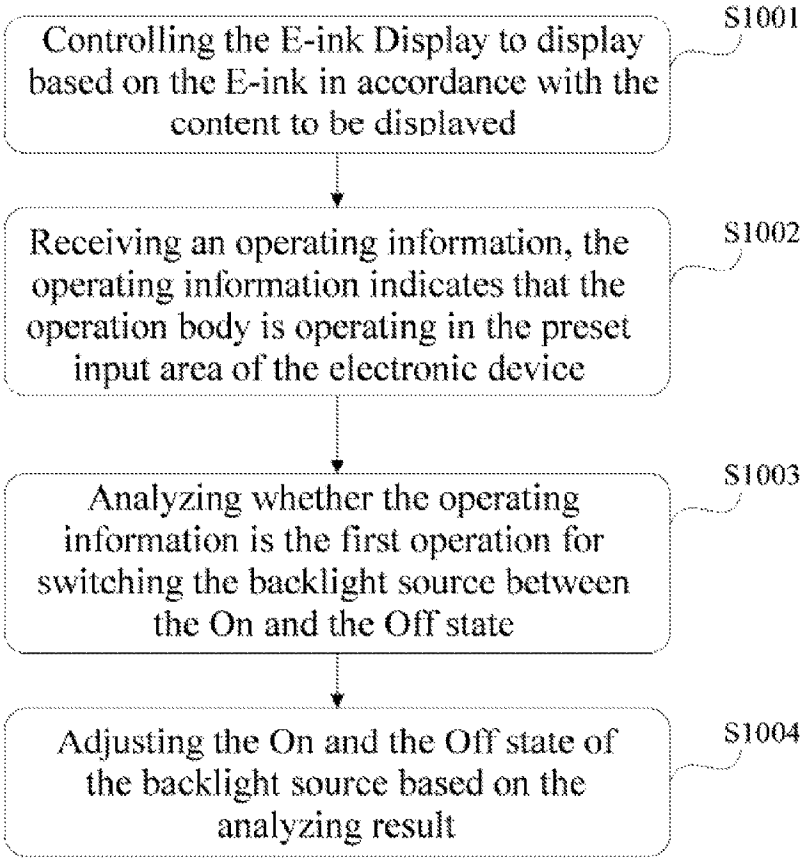
FIG. 10 is a flow chart of a display method embodiment 5.

See FIG. 10, it is a flow chart of a display method embodiment 5; the method comprises the following steps. Step S1001: controlling the E-ink Display to display based on the E-ink in accordance with the content to be displayed. Step S1001 is the same as step S701 in embodiment 2, therefore no redundant descriptions are comprised in this embodiment.

Step S1002: receiving operating information, the operating information indicates that the operation body is operating in the preset input area of the electronic device, wherein, the input area used for switching between the On and the Off state for the backlight source can also be provided in the electronic device. Specifically, the input area can be a physical key of the electronic device or the virtual key in the touch screen of the electronic device.

Step S1003: analyzing whether the operating information is the first operation for switching the backlight source between the On and the Off state, and once the operating information is received, determining whether the key is the corresponding first operation for the first key which controls the switching of backlight source state on the basis of the corresponding key value information for the operating information. In the case that the key for turning on the backlight source and the key for turning off the backlight source is a reusable key, the processor controls the switching of the state for the backlight source on the basis of the current condition for the E-ink Display and the operation of pressing the key. In the case that the operation is analyzed as the first operation for switching of the backlight source state, it can also analyze whether the key is a reusable key or an independent function key on the basis of the corresponding key value information for the operating information.

Step S1004: Adjusting the On and the Off state of the backlight source based on the analyzing result. In the case that the key for turning on the backlight source and the key for turning off the backlight source is a reusable key, the processor controls the switching of the state for the backlight source on the basis of the current condition for the E-ink Display and the operation of pressing the key. In the case that the key for turning on the backlight source and the key for turning off the backlight source are mutually independent function keys, the processor controls adjusting of the state for the backlight source on the basis of the function for the triggered key only.

In conclusion, the embodiment provides a display method, wherein adjusting the On and the Off state of the backlight source of the electronic device according to the preset information, comprising: receiving operating information, the operating information indicates that the operation body is operating in the preset input area of the electronic device; analyzing whether the operating information is the first operation for switching the backlight source between the On and the Off state; and adjusting the On and the Off state of the backlight source based on the analyzing result. The preset input area for manual control of the backlight source for users is set in the electronic device, adopting this method, users can control the backlight source on the basis of their own experiences, which brings a high user engagement and improves the user experience. The process for switching the backlight source of the electronic device to the On state from the Off state in this embodiment.

Figure 11:
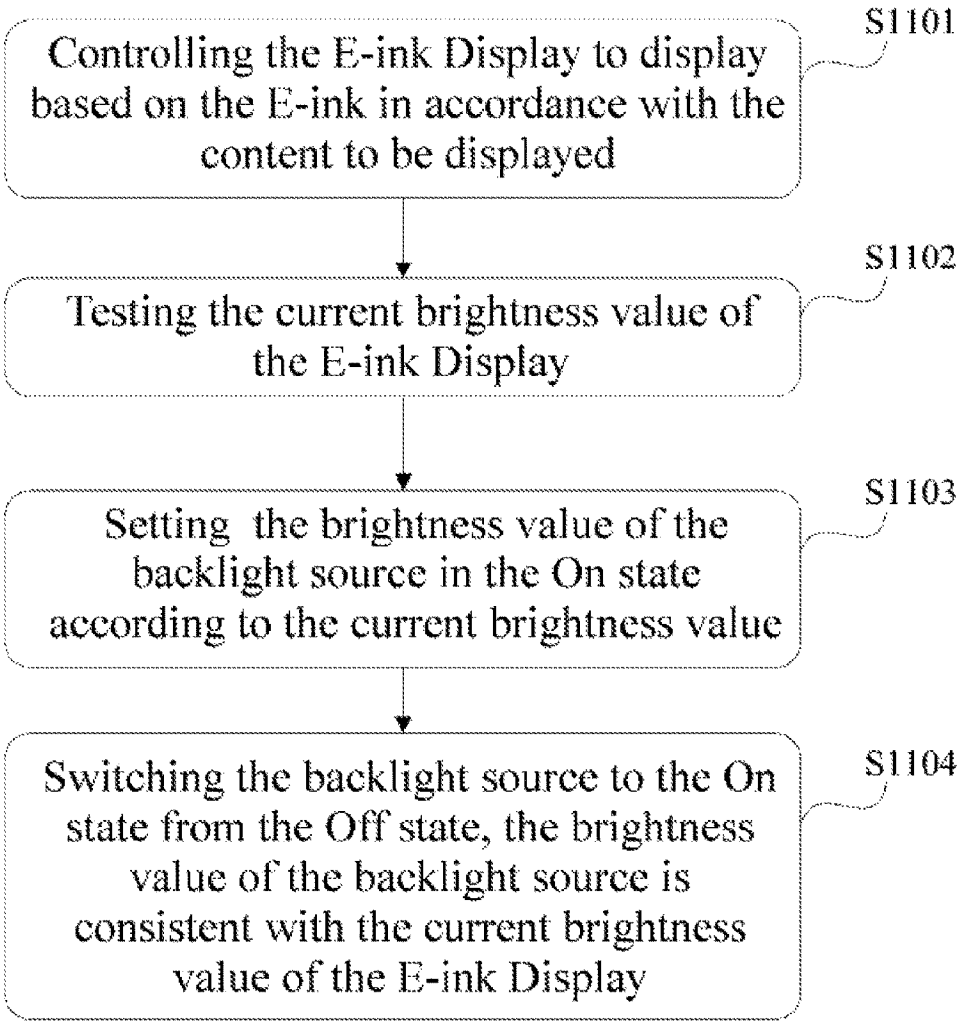
FIG. 11 is a flow chart of a display method embodiment 6.

See FIG. 11, it is a flow chart of a display method embodiment 6; the method comprises the following steps. Step S1101: controlling the E-ink Display to display based on the E-ink in accordance with the content to be displayed, wherein, step S1101 is the same with step S701 in embodiment 2, therefore no redundant descriptions are comprised in this embodiment.

Step S1102: testing the current brightness value of the E-ink Display, wherein a light sensor can be preset in the electronic device to test the current brightness value of the E-ink Display. Note that the current brightness value of the E-ink Display is the brightness value achieved by releasing the energy of the energy storage particles.

Step S1103: setting the brightness value of the backlight source in the On state according to the current brightness value. Note that the brightness value of the backlight source in E-ink Display can be preset. In the embodiment, the initial brightness value of the backlight source is set on the basis of the current brightness value of the E-ink Display achieved on the basis of the energy storage particles. As a specific example, in the case that the energy released by the energy storage particles achieved the brightness value of 10 lux (lx), the brightness value of the backlight source in the On state is then set as 10 lux. In an embodiment, as a range of light intensity is adopted in the electronic device for setting brightness, the 10 lux corresponds to 20 in the light intensity range of 0-100 for the brightness value of the backlight source, thereby; the light intensity of the backlight source in the On state can be directly set as 20.

Step S1104: switching the backlight source to the On state from the Off state, the brightness value of the backlight source is consistent with the current brightness value of the E-ink Display. In an embodiment, controlling the backlight source to switch to the on state on the basis of the instruction for switching the backlight source to the On state from the Off state, and once the backlight source switched to on state, the initial brightness value is the brightness value of the E-ink Display achieved on the basis of the energy storage particles.

Note that when the backlight source switched into the On state from the Off state, its initial brightness value is the same as the brightness value of the E-ink Display achieved on the basis of releasing energy by the energy storage particles, once the switching is done, there is no change on the brightness value of the E-ink Display and no case of the E-ink Display directly switching from darker to lighter is appeared, the eyes of users are adapted to the switching of light source between energy storage particles and backlight source without the dazzling feeling, thereby the user experience is improved.

In conclusion, the embodiment provides a display method, further comprising: testing the current brightness value of the E-ink Display; setting the brightness value of the backlight source in the On state according to the current brightness value; switching the backlight source to the On state from the Off state, the brightness value of the backlight source is consistent with the current brightness value of the E-ink Display. Adopting this method, once the switching is done, there is no change on the brightness value of the E-ink Display and no case of the E-ink Display directly switching from darker to lighter is apparent. The eyes of users are adapted to the switching of light source between energy storage particles and backlight source without the dazzling feeling; thereby the user experience is improved.

Figure 12:
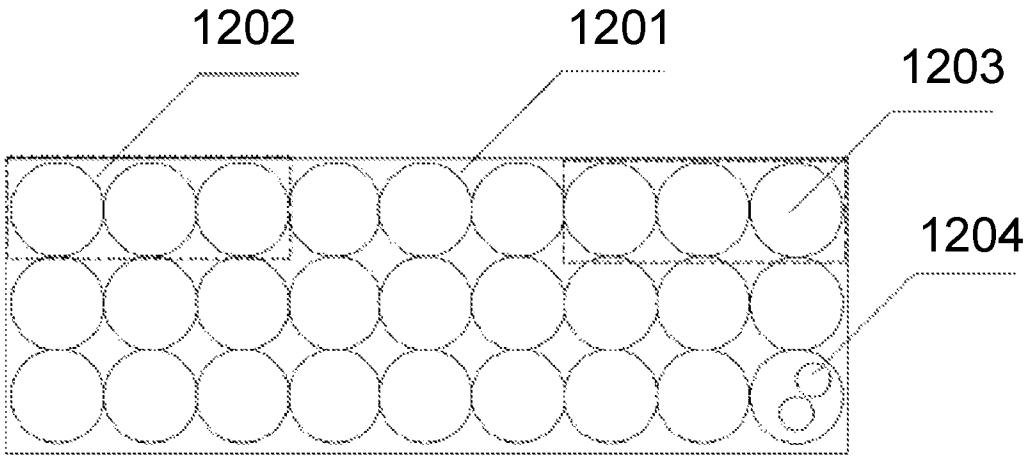
FIG. 12 is a schematic structure diagram of an E-ink Display embodiment 7.

See FIG. 12, a schematic structure diagram of an E-ink Display embodiment 7, the schematic structure diagram is a top view. In an embodiment, the E-ink Display 1201 comprises a compartment group 1202; each compartment group 1202 comprises at least three compartments. FIG. 12 of this embodiment takes the compartment group comprising three compartments as the example for description.

The E-ink Display 1201 comprises at least two compartment groups 1202. Each compartment group comprises at least three compartments 1203, the compartments are provided with the ink particles 1204, the color of the ink particles in any two compartments of the same compartment group are different, and based on the ink particles the pixel color of the compartment group can be adjusted.

In FIG. 12, the dotted box is adopted for representing a compartment group; the compartment group consisting of three compartments is taken as the example for description in this figure. As the color of ink particles in each compartment of the compartment group are different, each compartment group corresponds with a pixel, based on the ink particles the pixel color of the compartment group can be adjusted and the compartments in the E-ink Display constitute a massive quantity of pixels, which can realize the displaying of the images to be displayed and because the compartments are provided with ink particles with different colors, a rich color display is achieved, thereby improving the user experience.

Note that the compartment adopted in this embodiment is very small in size, and in specific implementations, it can be a small "microcapsule" attached to the surface of the E-ink Display. The ink particles are the particles with various colors encapsulated in the microcapsule.

Figure 13:
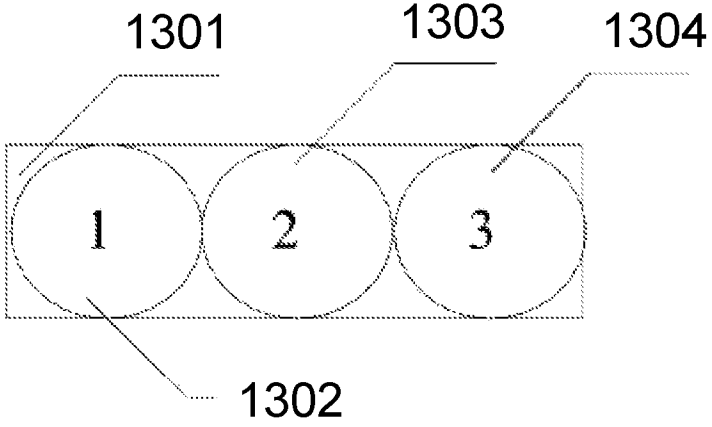
FIG. 13 is a schematic structure diagram of the compartment group in an E-ink Display embodiment 8.

See FIG. 13, a schematic structure diagram of the compartment group in an E-ink Display embodiment 8. In an embodiment, the compartment group 1301 comprises three compartments of 1302 to 1304, and the three compartments in the compartment group are respectively provided with one of the ink particles with three primary colors.

In an embodiment, the three primary colors are the primary colors: red, yellow and blue, thereby, the three compartments in the compartment group are respectively provided with one color of the three primary colors. Note that the present application has no limits on the number of ink particles for any of the compartments. Also note that the shape of the compartment is not limited to a square as in the drawings, it can be other shapes such as sphere, columnar structure, oval or cone structure, and the present application has no limits on the shape of the compartment.

In drawings referenced herein, compartments with "1" are used for representing the compartments with red ink particles, compartments with "2" are used for representing the compartments with yellow ink particles and compartments with "3" are used for representing the compartments with blue ink particles. In an embodiment, the electron affinity of any two colored ink particles of the ink particles with three primary colors is different. Therefore, when a certain voltage is applied on the compartment group, ink particles in each compartment move differently in distance, resulting in various final locations.

Figure 14:
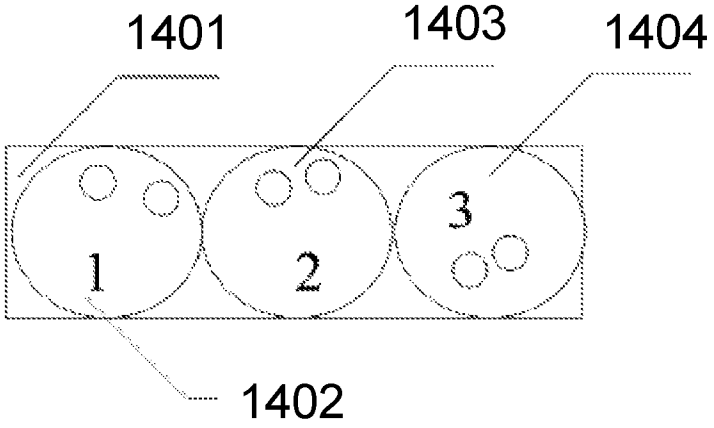
FIG. 14 is a schematic diagram of the compartment group scenario in an E-ink Display embodiment 8.

See FIG. 14, a schematic diagram of the compartment group scenario in an E-ink Display embodiment 8, in the scenario, the compartment group 1401 comprises 3 compartments of 1402 to 1404. Applying voltage on the compartment group to prompt movement of the ink particles in the compartment group, wherein the red ink particles in compartment 1402 move upward for a long distance under the effect of the voltage, the yellow ink particles in compartment 1403 move upward under the effect of the voltage, and the blue ink particles in compartment 1404 move downward under the effect of the voltage. The pixel color finally represented by the compartment group is the orange mixed by red and yellow, wherein the upward direction is the direction pointing to the E-ink Display, the outside is the side where the user is located.

Note that various colors can be acquired from the mixture of three primary colors; therefore the acquired color of the compartment group can be controlled by applying corresponding voltage on the compartment group to control the movement of the ink particles in compartments.

Note that as the ink particles of each color possess different electron affinities, the corresponding voltage should be determined just based on the pixel color corresponding to the compartment group, and then apply the voltage on the compartment group to represent the corresponding color. Conduct the corresponding control on each compartment in the E-ink Display successively based on each pixel in the image to accomplish the goal of displaying the color image based on the E-ink Display.

Figure 15:
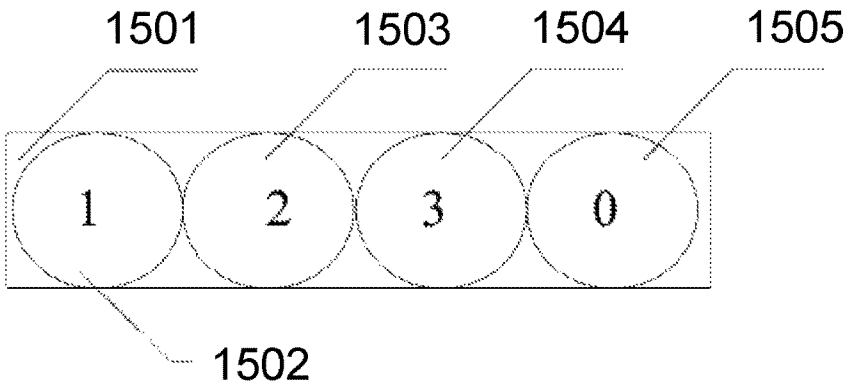
FIG. 15 is a schematic structure diagram of the compartment group in an E-ink Display embodiment 9.

See FIG. 15, is a schematic structure diagram of the compartment group in an E-ink Display embodiment 9, wherein the compartment group 1501 comprises four compartments of 1502 to 1505, and the four compartments in the compartment group are respectively provided with one of the ink particles with three primary colors and the ink particles with the preset color. In an embodiment, the three primary colors are the primary colors of yellow, red, and blue, the preset color can be black and/or white.

In drawings referenced herein, compartments with "1" are used for representing the compartments with red ink particles, compartments with "2" are used for representing the compartments with yellow ink particles, compartments with "3" are used for representing the compartments with blue ink particles and compartments with "0" are used for representing the compartments with ink particles with the preset color.

Note that in the case where the preset color is just one color (i.e. black or white), there can be four compartments in the compartment group. In the case where the preset color comprises black and white, there can be five compartments in the compartment group, the black ink particles are provided in one compartment, while the white ink particles are provided in another compartment.

In an embodiment, the black ink particles and the white ink particles can be provided with opposite electron affinities, thereby, the black ink particles and white ink particles can be provided in the same compartment; and based on the voltage applied on the compartment, the black ink particles and the white ink particles will move to the opposite directions. In an embodiment, the electron affinity of the ink particles with three primary colors is different from that of the ink particles with the preset color. Therefore, when a certain voltage is applied on the compartment group, ink particles in each compartment move differently in distance, resulting in various final locations.

Figure 16:
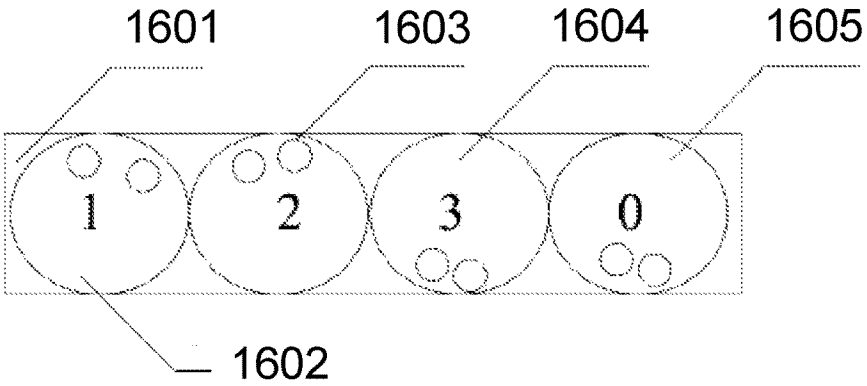
FIG. 16 is a schematic diagram of the compartment group scenario in an E-ink Display embodiment 9.

See FIG. 16, a schematic diagram of the compartment group scenario in an E-ink Display embodiment 9. In the scenario, the compartment group 1601 comprises 4 compartments of 1602 to 1605, applying voltage on the compartment group to prompt the moving of the ink particles in the compartment group. The red ink particles in compartment 1602 move upward for a long distance under the effect of the voltage, the yellow ink particles in compartment 1603 move upward under the effect of the voltage, and the blue ink particles in compartment 1604 move downward under the effect of the voltage, the black particles in compartment 1605 move to the most inside part of the compartment under the effect of the voltage. The pixel color finally represented by the compartment is the orange mixed by red and yellow.

In an embodiment, the upward direction is the direction pointing to the of the E-ink Display, the outside is the side where the user is located; the inside is the opposite side to the outside. Note that in case a black image content is required to be displayed in the E-ink Display, it just requires to determine the corresponding voltage based on the pixel of the content to be displayed and then apply the voltage on the compartment group, thereby, making the black particles in each compartment to move to the most inside part of the compartment under the effect of the voltage to represent the corresponding color.

Figure 17:
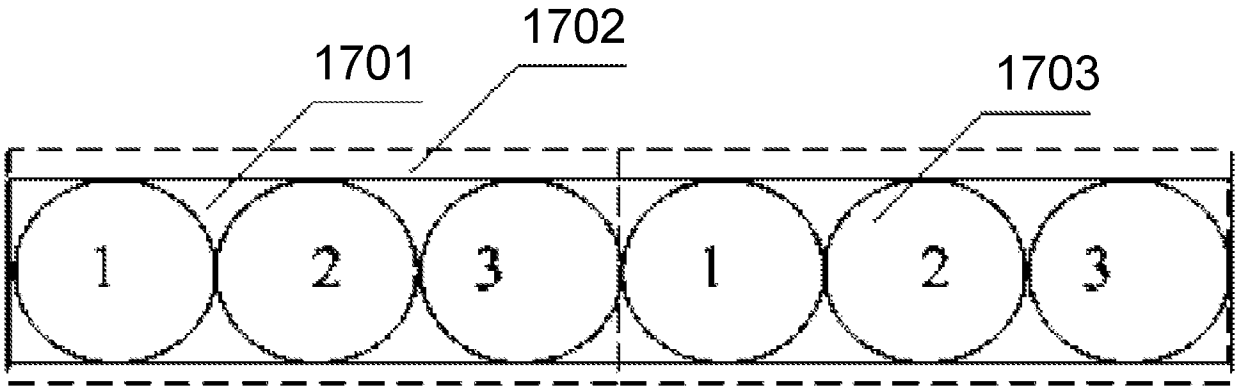
FIG. 17 is a schematic structure diagram of an E-ink Display embodiment 10.
Figure 21:
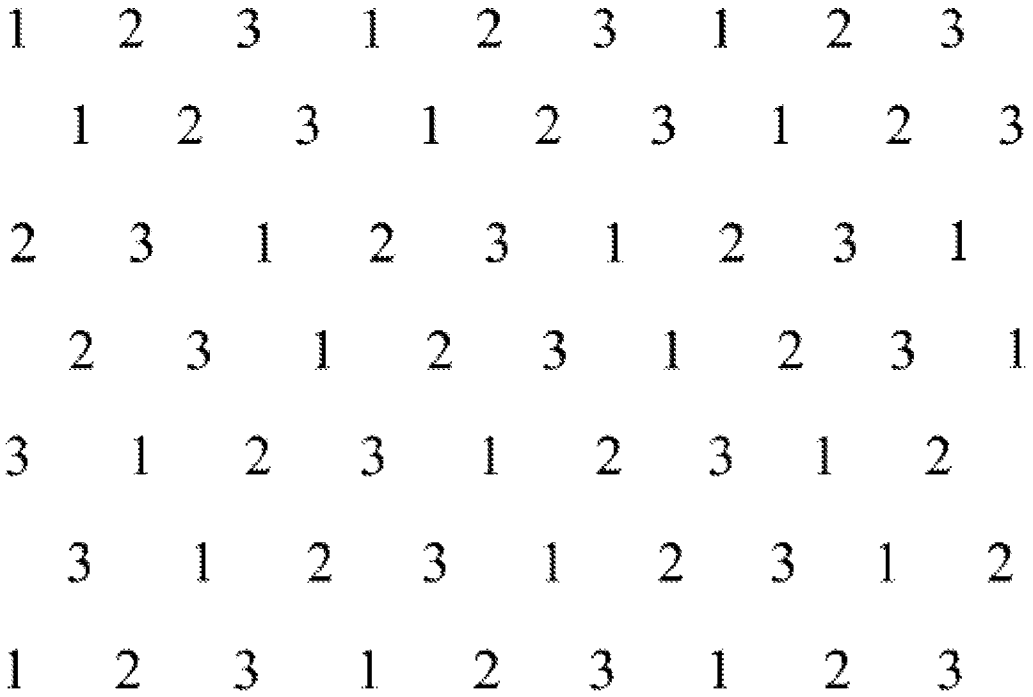
FIG. 21 is further another specific schematic structure diagram of an E-ink Display embodiment 10.

See FIG. 17, is a schematic structure diagram of an E-ink Display embodiment 10. The E-ink Display 1701 comprises compartment group 1702, each compartment group 1702 comprises three compartments 1703 at least. FIG. 17 of this embodiment takes two compartment groups, wherein the compartment group comprising three compartments as the example for description, wherein arrangement order of the compartments provided with the ink color particles in any two compartment groups is the same.

For example, the arrangement order of the ink color particles in the compartments of the first compartment group is red-yellow-blue; successively the arrangement order in the subsequent compartment groups is further red-yellow-blue.

For example, the arrangement order of the ink color particles in the compartments of the first compartment group is red-yellow-blue-black; successively the arrangement order in the subsequent compartment groups is further red-yellow-blue-black. In an embodiment, the compartments in the E-ink Display are arranged successively in a matrix arrangement mode.

In FIGS. 18 to 21, number "1" is used for representing the compartments with red ink particles, number "2" is used for representing the compartments with yellow ink particles, number "3" is used for representing the compartments with blue ink particles and number "0" is used for representing the compartments with ink particles with the preset color.

See FIG. 18, a specific schematic structure diagram of an E-ink Display embodiment 10, wherein, ink particles in the compartments are with three primary colors and a matrix arrangement mode is adopted as the arrangement mode of the compartments. The initial compartment color varies between each row of compartments.

See FIG. 19, another specific schematic structure diagram of an E-ink Display embodiment 10, wherein ink particles in the compartments are with three primary colors and a matrix arrangement mode is adopted as the arrangement mode of the compartments. The compartments in the E-ink Display arrange in rows vertically and horizontally, compartments in a vertical row share the same color, wherein the E-ink Display shown in FIG. 19, the length of the vertical row is triple that of the horizontal row.

See FIG. 20, yet another specific schematic structure diagram of an E-ink Display embodiment 10, wherein ink particles in the compartments are with three primary colors and the preset color, the four compartments in each compartment group are adjacent to each other and a matrix arrangement mode is adopted as the arrangement mode of the compartment groups.

In an embodiment, the compartments in the E-ink Display are arranged in a honeycomb arrangement mode. See FIG. 21, further another specific schematic structure diagram of an E-ink Display embodiment 10, wherein ink particles in the compartments are with three primary colors and a honeycomb arrangement mode is adopted as the arrangement mode of the compartments. The initial compartment color varies between each row of compartments.

An E-ink Display is described in detail in the embodiment above, wherein there are multiple forms of electronic devices for realizing the methods of an embodiment, therefore, an electronic device comprising the E-ink Display is further provided, and the specific embodiment is explained in detail below.

Figure 22:
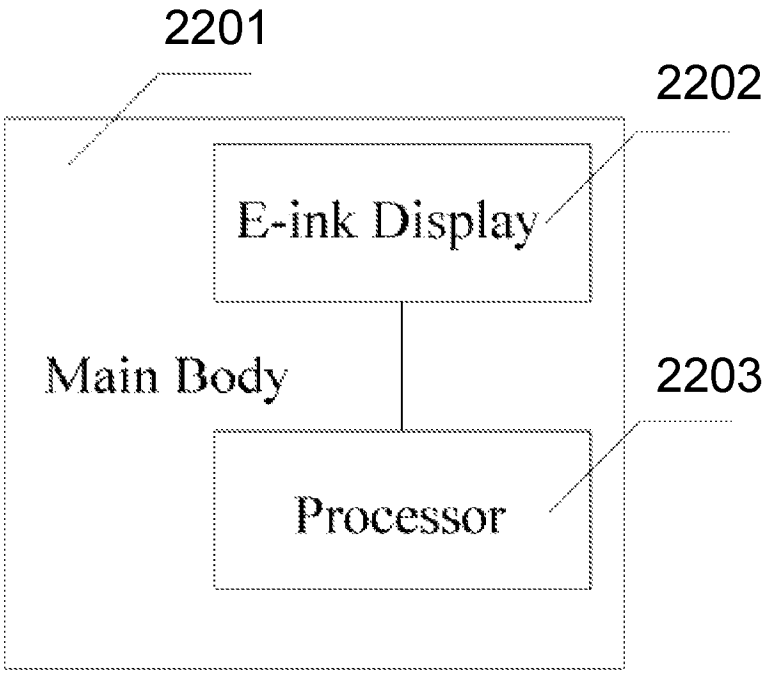
FIG. 22 is a schematic structure diagram of an electronic device embodiment 7.

See FIG. 22, a schematic structure diagram of an electronic device embodiment 7, the electronic device can be a notebook computer, tablet computer, mobile phone, smart TV, smart watch, wearable device, and the like. The electronic device comprises the following structures: main body 2201, E-ink Display 2202 and processor 2203.

The E-ink Display 2202 is provided on the main body 2201, the E-ink Display comprises at least two compartment groups, each compartment group comprises at least three compartments, the compartments are provided with ink particles, the color of the ink particles in any two compartments of the same compartment group are different, and based on the ink particles the pixel color of the compartment group can be adjusted.

The processor 2203 being connected to the E-ink Display 202 is used for controlling the displaying of the image to be displayed on the E-ink Display based on the pixels of the E-ink Display. In specific implementations, structures with information processing capability such as GPU (Graphic Processing Unit) and CPU (central processing unit) in the electronic device can be adopted as the processor.

Particularly, each of the compartment groups is provided with three compartments, the three compartments in the compartment group are respectively provided with one of the ink particles with three primary colors, and the electron affinity of any two colored ink particles of the ink particles with three primary colors is different, specifically, the processor is used for: acquiring each pixel information of the image to be displayed; analyzing the pixel information to acquire the tricolor value of each pixel; acquiring a first on-load voltage of the corresponding compartment group through calculation based on the tricolor value of the pixel; providing the voltage for the corresponding compartment group in the E-ink Display based on the first on-load voltage so as to facilitate the ink particles with three primary colors to move under the effect of the voltage; and acquire the pixel color corresponding with the pixel information of the image to be displayed.

Note that as the ink particles of each color possess different electron affinities, the corresponding voltage should be determined just based on the pixel color corresponding to the compartment group, then the voltage applied on the compartment group to represent the corresponding color. Conduct the corresponding control on each compartment in the E-ink Display successively based on each pixel in the image to accomplish the goal of displaying the color image based on the E-ink Display.

In an embodiment, each of the compartment groups is provided with four compartments, the four compartments in the compartment group are respectively provided with one of the ink particles with three primary colors and the ink particles with the preset color, and the electron affinity of the ink particles with three primary colors is different from that of the ink particles with the preset color, specifically, the processor is used for: acquiring each pixel information of the image to be displayed; judging whether the pixel information is a color information to acquire a first judging result; characterizing the pixel information as color information based on the first judging result, analyzing the pixel information to acquire the tricolor value of each pixel; acquiring a second on-load voltage of the corresponding compartment group through calculation based on the tricolor value of the pixel; providing a voltage for the corresponding compartment group in the E-ink Display based on the second on-load voltage, so as to facilitate the ink particles with three primary colors and the ink particles with the preset color to move under the effect of the voltage, and acquire the pixel color corresponding with the pixel information of the image to be displayed; characterizing the pixel information as non-color information based on the first judging result; analyzing the pixel information to acquire the preset color information of each pixel; acquiring a third on-load voltage of the corresponding compartment group through calculation based on the preset color information of each pixel; providing a voltage for the corresponding compartment group in the E-ink Display based on the third on-load voltage, so as to facilitate the ink particles with three primary colors and the ink particles with the preset color to move under the effect of the voltage, and acquire the pixel color corresponding with the pixel information of the image to be displayed.

The electron affinity of the ink particles with three primary colors is different from that of the ink particles with the preset color, therefore, when a certain voltage is applied on the compartment group, ink particles in each compartment move differently in distance, resulting in various final locations.

Note that in the case when black image content is required to be displayed in the E-ink Display, it just requires an embodiment to determine the corresponding voltage based on the pixel of the content to be displayed and then apply the voltage on the compartment group, thereby making the black particles in each compartment move to the most inside part of the compartment under the effect of the voltage to represent the corresponding color.

In an embodiment, arrangement order of the compartments provided with the ink color particles in any two compartment groups is the same. In an embodiment, the compartments in the E-ink Display are arranged successively in a matrix arrangement mode. In an embodiment, the compartments in the E-ink Display are arranged in a honeycomb arrangement mode.

Each embodiment in this specification is described in a progressive way, the highlight for each embodiment is the difference between other embodiments and the similar parts for each embodiment may refer to each other. For the devices provided by the embodiments, as they correspond to the methods provided by the embodiments, the descriptions for them are simple and the relevant parts can be seen in the descriptions of the method parts.

A person skilled in the art should be able to implement or use an embodiment, after reading the description of the embodiments provided above. Various modifications of these embodiments would be apparent to a person skilled in the art; the general principle defined herein can further be implemented in other embodiments without departing from the spirit or scope of the present invention. Accordingly, the present invention will not be limited to the embodiments demonstrated herein, but encompass the broadest scope that is consistent with the principle and novelty provided herein.

The technical solution in the embodiments herein is described expressly and completely as follows with reference to the drawings. It is clear that the embodiments described are not all, but only some of the embodiments of the present invention. All other embodiments acquired based on the embodiments of the present invention by those of ordinary skill in the art without any creative work fall within the scope of the present invention.

It shall be understood that the devices and methods disclosed in the embodiments of the application may be implemented in other ways. The device embodiments as described above are only for illustrative purposes. Specifically, the definition of units described herein is only a logical definition, and other definition methods can be employed in practical application. For example, multiple units or components may be combined, or integrated into another system, or some features may be omitted or not implemented. Additionally, coupling, direct coupling, or communication connections among the components as shown or discussed may be implemented through some interface(s), and indirect coupling or communication connections of devices or units may be in an electrical, mechanical, or other form.

The units described above as separate components may or may not be separated physically. The components illustrated as units may or may not be physical units, i.e., they can be located in one place or can be distributed to multiple network units. The functions of the embodiments can be achieved by some or all of the units, according to actual requirements.

Moreover, various functional units of various embodiments can all be integrated in one processing unit, or each unit may function as a single unit, or two or more units may be integrated in one unit; the integrated units may be realized by hardware, or by a functional unit with hardware and software.

A person skilled in the art should understand that all or certain steps to realize the embodiments of the methods may be accomplished by relevant hardware via program commands. The program may be stored in a readable, non-transitory storage media of a computer, where a non-transitory media includes all media other than signal media. When the program runs, the steps of the embodiments of the methods can be implemented. The storage media comprises mobile storage devices, read-only memories (ROM), random access memories (RAM), diskettes or disks, and other various types of media of program code storage.

Alternatively, if the integrated units described in an embodiment are realized by functional modules of software and sold or used as independent products, they may be stored in a readable, non-transitory storage media of a computer. Based on such understanding, the technical aspects of the embodiments can essentially be, or the parts that contribute to the current technology can be, embodied in the form of software products. Software products of the computer are stored in one non-transitory storage media, including numerous commands to make one computer device (likely, a computer, server, or network device, etc.) implement all or part of the methods described in each embodiment. The non-transitory storage media comprises mobile storage devices, read-only memories (ROM), random access memories (RAM), diskettes or disks, and other various types of media of program code storage.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. An electronic device, comprising:

a body;

an E-ink display disposed on the body, the E-ink display housing E-ink material, the E-ink material comprising at least one ink particle and at least one energy storage particle;

a backlight source disposed between the body and the E-ink display;

a processor, operatively connected to the E-ink Display, for controlling the E-ink display to display content;

wherein, the at least one energy storage particle is used for:

receiving and storing ambient light energy when ambient light intensity exceeds a first threshold; and releasing stored ambient light energy when ambient light intensity is below a second threshold, the first threshold being less than or equal to the second threshold;

wherein the processor is used for controlling the backlight source to automatically switch between an On state and an Off state, wherein when the backlight source is on, brightness of the E-ink display is higher than when the backlight source is off;

wherein instructions executable by the processor to control the backlight source to switch between the On state and the Off state control the backlight source to automatically switch to the on state when a stored ambient light energy level of the at least one energy storage particle falls below a predetermined threshold.

2. The electronic device according to claim 1, wherein controlling the backlight source to switch from the Off state to the On state comprises:

testing a current brightness value of the E-ink Display; and setting a brightness level of the backlight source in the On state according to the current brightness value, wherein the brightness level is consistent with the current brightness value when the backlight source is switched to the On state.

3. The electronic device according to claim 1, further comprising:

a first sensor, wherein the first sensor detects energy stored by the at least one energy storage particles in the E-ink Display, and obtains a value of the energy stored by the E-ink Display;

the processor, further used for:

determining a value of the energy stored by the E-ink Display relative to a third threshold to obtain a first determination result;

turning on the backlight source when the first determination result indicates that the value of the energy stored by the E-ink Display is smaller than the third threshold; and turning off the backlight source when the first determination result indicates that the value of the energy stored by the E-ink Display is greater than the third threshold.

4. The electronic device according to claim 1, further comprising:

a second sensor, used for testing the energy stored by the at least one energy storage particle in the E-ink Display to obtain a value of the energy stored by the E-ink Display, and testing the ambient light intensity value of the E-ink Display;

the processor, further used for:

determining a value of the energy stored by the E-ink Display relative to a third threshold to obtain a first determination result;

determining the ambient light intensity value relative to a fourth threshold to obtain a second determination result; and turning on the backlight source when the first determination result indicates that the value of the energy stored by the E-ink Display is smaller than the third threshold, and when the second determination result indicates that the ambient light intensity value is smaller than the fourth threshold.

5. The electronic device according to claim 1, further comprising:

an input unit, used for receiving operating information, the operating information indicating that an operation body is operating in a preset input area of the electronic device;

the processor, further used for analyzing whether the operating information is a first operation for switching the backlight source between the On and the Off state; and adjusting the On and the Off state of the backlight source based on the analyzing result.

6. A method, comprising:

displaying, on a display device, visual information represented via electronic ink, wherein the electronic ink comprises a plurality of particles, wherein the plurality of particles comprise at least one ink particle and at least one energy storing particle;

modifying, using a processor and a backlight source disposed behind the display device, the display device to increase visibility of the electronic ink, wherein said modifying comprises:

controlling, using the processor, the backlight source to automatically switch between an On state and an Off state, wherein when the backlight source is on, brightness of the display device is higher than when the backlight source is off; and wherein the controlling comprises controlling the backlight source to automatically switch to the On state when a stored ambient light energy level of the at least one energy storing particle falls below a predetermined threshold.

7. The method of claim 6, wherein the at least one energy storing particle can store light energy.

8. The method of claim 7, further comprising:

detecting, using a sensor, a level of ambient light;

responsive to the detecting, storing ambient light energy in the energy storing particle when the level of ambient light exceeds a threshold; and responsive to the detecting, releasing, from the energy storing particle, stored ambient light energy when the level of ambient is below the threshold.

9. The method of claim 6, wherein the plurality of particles comprise at least one particle group, the particle group comprising at least one particle associated with each primary color.

10. The method of claim 9, wherein the electron affinity of any two ink particles, each of which is provided with one of three primary colors, is different.

* * * * *